US007651420B1

(12) United States Patent
Gaff et al.

(10) Patent No.: US 7,651,420 B1
(45) Date of Patent: Jan. 26, 2010

(54) INJECTION-MOLDED BALL BAT

(75) Inventors: Bradley L. Gaff, Portland, OR (US); Hsin Feng Lin, Taichung (TW)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 12/220,552

(22) Filed: Jul. 25, 2008

(51) Int. Cl.
*A63B 59/06* (2006.01)

(52) U.S. Cl. ..... 473/567

(58) Field of Classification Search ..... 473/457, 473/519, 520, 564–568
See application file for complete search history.

(56) References Cited

U.S. PATENT DOCUMENTS

| | | | | |
|---|---|---|---|---|
| 3,830,496 | A | 8/1974 | Reizer | 273/72 |
| 4,374,590 | A | 2/1983 | Everlith et al. | 273/326 |
| 4,541,629 | A | 9/1985 | Witkowski | 273/72 |
| 5,301,940 | A | 4/1994 | Seki et al. | 273/72 |
| 5,303,917 | A | 4/1994 | Uke | 273/72 |
| 6,048,283 | A | 4/2000 | Albarelli, Jr. | 473/567 |
| 6,352,485 | B1 | 3/2002 | Philpot et al. | 473/564 |
| 6,425,836 | B1 | 7/2002 | Misono et al. | 473/567 |
| 2004/0082413 | A1 | 4/2004 | Leal et al. | 473/564 |
| 2006/0254938 | A1 | 11/2006 | Ward, III et al. | 206/315.1 |

*Primary Examiner*—Mark S Graham
(74) *Attorney, Agent, or Firm*—Terence P. O'Brien

(57) ABSTRACT

A bat and a method of making a bat for use in sports, such as baseball. The bat includes a one-piece, hollow bat frame formed by injection molding a durable polymer, such as acrylonitrile butadiene styrene. The bat frame includes a barrel portion, an intermediate portion, and a handle portion, with at least one of the portions having a polygonal cross-section on an interior surface of the bat.

18 Claims, 2 Drawing Sheets

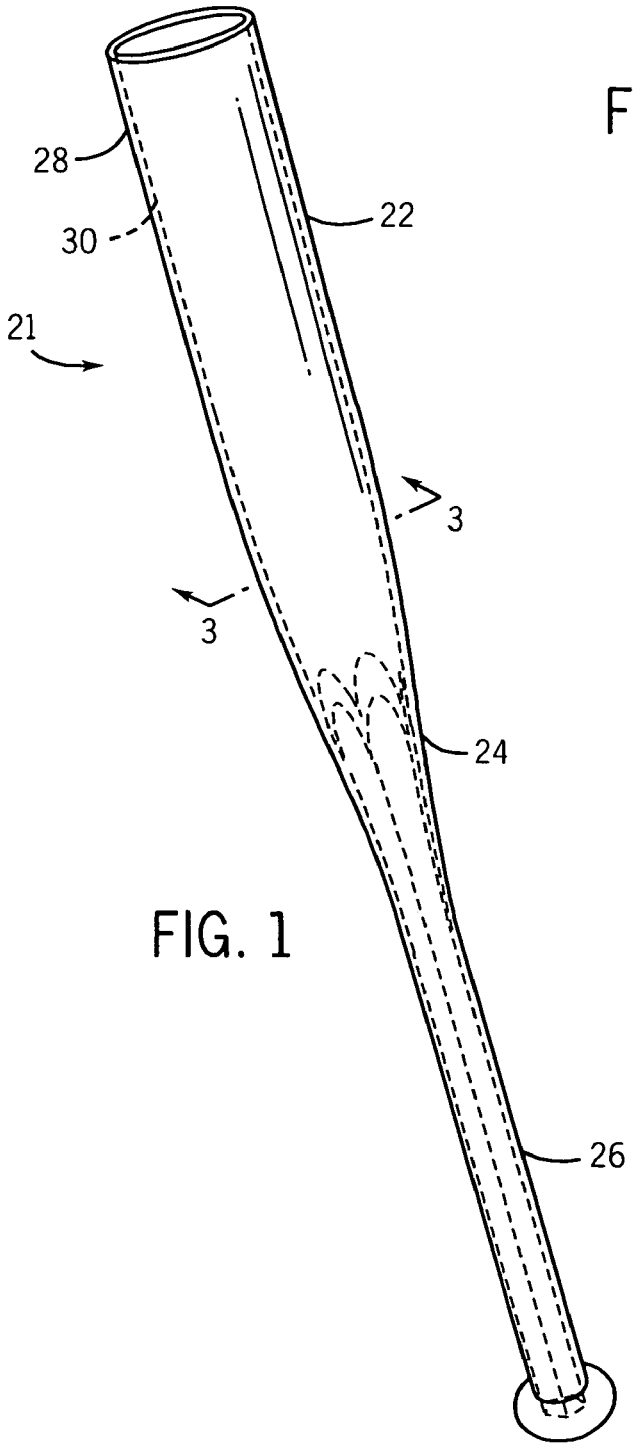
FIG. 1
FIG. 2
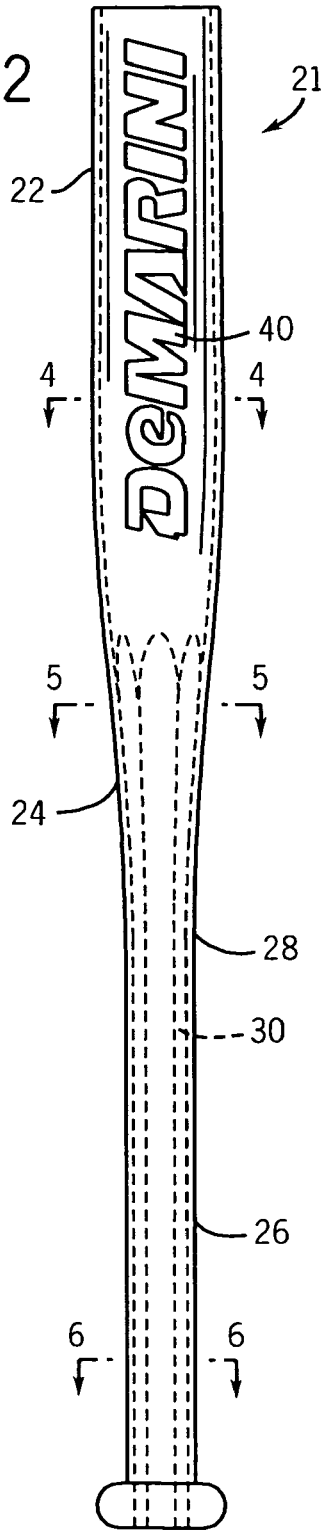

INJECTION-MOLDED BALL BAT

FIELD OF THE INVENTION

The present invention relates to an injection-molded bat for use in sports, and method of making the bat.

BACKGROUND OF THE INVENTION

Sports bats, such as baseball bats, tee-ball bats or softball bats, must be sufficiently strong and durable to withstand the impact of a ball against the bat during play. Additionally, the bats should possess an appropriate amount of stiffness in order to provide the desired performance characteristics.

Originally, baseball bats were made of wood. Wood ball bats provide many beneficial features, however, they are prone to failure, and can be too heavy for younger players even at reduced bat lengths. Metal bats, such as aluminum alloy bats, were introduced as being more durable than wooden bats. However, metal bats are much more expensive than traditional wooden bats. Further, many metal bats were susceptible to dents and corrosion, and further lacked the superior "feel" of wooden bats. Later, ball bats formed of layers of fiber composite material were introduced. These bats also provide many advantageous features, but are generally very expensive, and therefore are simply not practical for many younger players.

Many metal bats and many composite type bats transfer vibrational and shock energy from the barrel portion of the bat to the handle portion of the bat, thereby producing an undesirable sting or vibration to the user's hands. Many players, particularly younger players, have difficulty hitting or do not enjoy hitting due to such unpleasant vibrational feedback.

Ball bats have also historically been made of a plastic material, such as a traditional "wiffle" type ball bat. Despite providing some advantages such as a low cost and light weight, these plastic bats still possess many drawbacks. For example, existing plastic or wiffle-style bats are simply not configured for organized competitive baseball or softball play. Rather, "wiffle" type bats are configured for impacting traditional, lightweight, plastic wiffle balls only. Such bats are generally not configured to withstand an impact with an actual baseball or softball. Such bats are typically blow-molded, which is an expensive process compared to injection molding; furthermore, the process of blow molding is limited to a narrower range of materials compared to injection molding.

Other plastic bats may be formed from an injection molding process. Although injection molding is an efficient, economical process, it can be difficult to use injection molding to produce a one-piece bat. Bats require a uniform thickness, particularly in a barrel section, in order for the bat to perform consistently. It is difficult to maintain the alignment of a one-piece bat having a circular cross-section along an entire length of the bat during the injection molding process. Some plastic bats are injection-molded in two or more parts, thereby adding to the complexity and often the price of the bat.

It would thus be desirable to provide a sports bat that is strong and durable and possesses desired performance and feel characteristics without being prohibitively expensive. What is needed is a lightweight, durable bat that provides exceptional feel characteristics particularly for younger players at an affordable price. It would also be desirable to provide a method of forming such a bat in an injection molding process without alignment difficulties.

SUMMARY OF THE INVENTION

The present invention presents a bat for use in baseball or other sports, and a method of making the bat. The bat features a polygonal cross-section that facilitates the manufacturing process and increases the strength and durability of the bat without increasing the bat's weight.

More particularly, the bat includes a one-piece, injection-molded, hollow bat frame having a barrel portion, a handle portion, and an intermediate portion that tapers from the barrel portion to the handle portion. At least one of the portions has a polygonal cross-section on an interior surface of the bat frame. The cross-section of the interior surface of the portion may be any non-circular, polygonal shape, such as a pentagon, hexagon, or square. In certain embodiments, only the handle portion includes the polygonal cross-section, or only the intermediate portion includes the polygonal cross-section, or both the handle portion and the intermediate portion include the polygonal cross-section, or both the intermediate portion and the barrel portion include the polygonal cross-section, or the polygonal cross-section may be present along the full length of the interior surface of the bat frame.

The barrel portion suitably has a circular cross-section on an exterior surface of the bat, and may also have a circular cross-section on an interior surface of the bat. The handle portion suitably has a circular cross section on an exterior surface of the bat.

The bat may be formed by injection molding a durable polymer, such as acrylonitrile butadiene styrene (ABS) to form the one-piece, hollow bat frame having the polygonal cross-section on an interior surface of the bat. The ABS may be formulated to include 15% to 35% acrylonitrile, 5% to 30% butadiene, and/or 40% to 60% styrene, for example.

In certain embodiments, the bat does not include any inserts within the bat frame, and includes no metallic parts. Two end caps may be attached to the ends of the bat frame, with one cap at the end of the barrel portion and the other cap at the end of the handle portion. The end caps may be formed of the same material as the bat frame, namely ABS. Graphical and/or alphanumeric indicia may be featured on the exterior surface of the bat.

Any one or more of the bat embodiments described herein may be used in baseball, softball, wiffleball, t-ball, and any other group sport that utilizes bats. The structure of the bat provides strength, durability, good performance, and a comfortable feel, and provides ease of alignment during the injection molding process.

BRIEF DESCRIPTION OF THE DRAWINGS

FIG. 1 is a perspective view of a diagram of a baseball bat frame.

FIG. 2 is a side view of a diagram of a baseball bat frame.

DETAILED DESCRIPTION OF THE INVENTION

Figure 3:
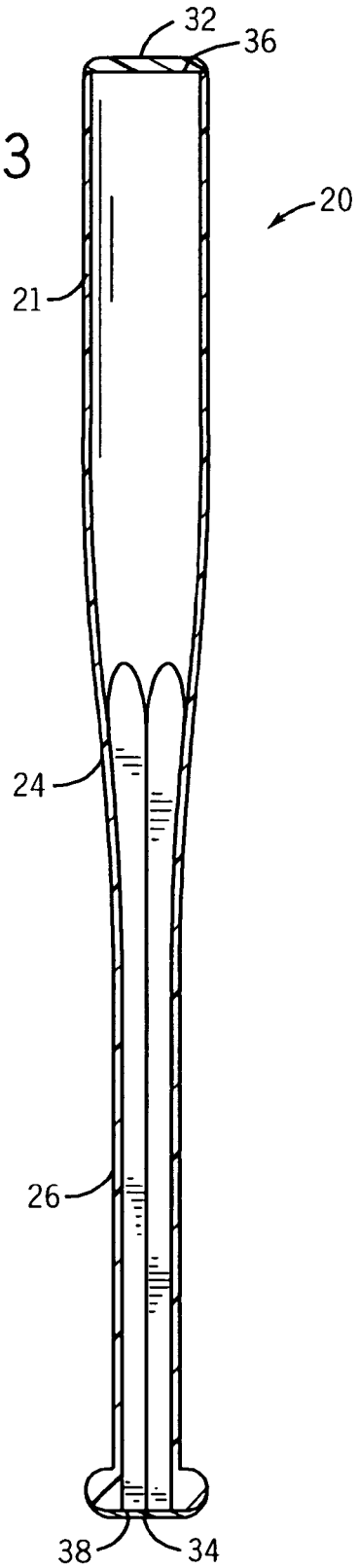
FIG. 3 is a side view of a baseball bat.

Referring to FIGS. 1 and 2, a frame of a baseball bat is indicated generally at 21. As illustrated in FIG. 3, a sports bat 20 according to the invention includes a one-piece, injection-molded, hollow bat frame 21. The structure of the bat frame 21 facilitates alignment while forming the bat 20 in an injection molding process. Additionally, the structure of the bat frame 21 results in a bat 20 having desirable performance properties.

Figure 4:
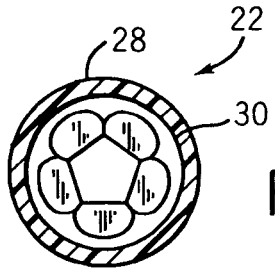
FIG. 4 is a cross-sectional view of a barrel portion of the baseball bat frame taken along line 4-4 in FIG. 2.
Figure 5:
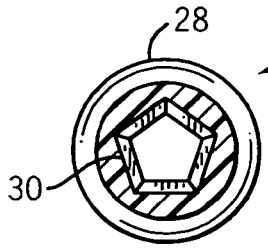
FIG. 5 is a cross-sectional view of an intermediate portion of the baseball bat frame taken along line 5-5 in FIG. 2.
Figure 6:
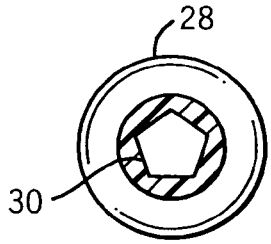
FIG. 6 is a cross-sectional view of a handle portion of the baseball bat frame taken along line 6-6 in FIG. 2.
Figure 7:
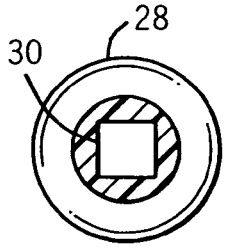
FIG. 7 is an alternative cross-sectional view of the handle portion of the baseball bat frame taken along line 6-6 in FIG. 2.
Figure 8:
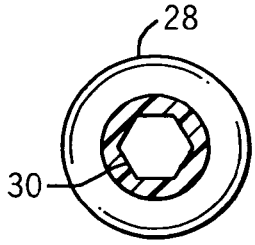
FIG. 8 is another alternative cross-sectional view of the handle portion of the baseball bat frame taken along line 6-6 in FIG. 2.

The bat frame 21 has a barrel portion 22, a handle portion 26, and an intermediate portion 24 that tapers from the barrel portion 22 to the handle portion 26. The barrel portion 22 has a circular cross-section on an exterior surface 28 of the bat and a circular cross-section on an interior surface 30 of the bat, as illustrated in FIG. 4. The intermediate portion 24 has a circular cross-section on the exterior surface 28 of the bat, and the cross-section of the interior surface 30 transitions from circular to polygonal, as illustrated in FIG. 5. The handle portion 26 suitably has a circular cross-section on the exterior surface 28 of the bat and a polygonal cross-section on the interior surface 30 of the bat, as illustrated in FIG. 6. The polygonal cross-section may be a pentagon, as shown in FIGS. 4-6. Alternatively, the polygonal cross-section may be a square, as shown in FIG. 7. As another alternative, the polygonal cross-section may be a hexagon, as shown in FIG. 8. Furthermore, the polygonal cross-section may be any other polygonal shape, or non-circular shape having edges, such as a triangle or an octagon, for example. As used herein, the term "cross-section," when used in reference to the barrel portion 22, intermediate portion 24, and/or handle portion 26 of the bat frame 21, refers to a cross-section cut perpendicular to an axis extending through the length of the bat frame 21.

In certain embodiments, the exterior surface 28 of the intermediate portion 24 and/or the handle portion 26 may have a polygonal cross-section rather than a circular cross-section. In any case, by maintaining a circular cross-section on both the interior surface 30 and the exterior surface 28 of the barrel portion 22, the bat 20 should display a consistent performance.

Various embodiments of the bat 20 include the interior surface 30 of the bat frame 21 having a polygonal cross-section only in the handle portion 26, or a polygonal cross-section only in the intermediate portion 24, or a polygonal cross-section in both the handle portion 26 and the intermediate portion 24, or a polygonal cross-section along the full length of the interior surface 30 of the bat frame 21, namely in the handle portion 26, intermediate portion 24, and the barrel portion 22, or a polygonal cross-section in just the intermediate portion 24 and the barrel portion 22. The wall thickness of the bat frame 21 is suitably evenly distributed within each cross-section of each portion of the bat frame 21, such that the bat 20 is not "weighted" on any particular side along the circumference of the cross-section.

The bat 20 is formed by injection molding a durable polymer to form the one-piece, hollow bat frame 21. The durable polymer is preferably acrylonitrile butadiene styrene (ABS). The composition of the polymer determines the stiffness and strength of various regions of the bat 20. Thus, the formulation of the polymer can be used to control the "feel" and "throw distance" of the bat 20. Acrylonitrile butadiene styrene typically includes 15-35% acrylonitrile, 5-30% butadiene, and 40-60% styrene. The amounts of acrylonitrile, butadiene, and styrene can be adjusted to achieve desired properties, such as greater or lesser stiffness.

In one preferred embodiment, the ball bat 20 is formed of a fiber-reinforced material, such as a fiber-reinforced ABS material. The fiber can be formed of fiberglass, aramid, carbon, Kevlar®, high molecular weight polyethylene in strand form, or other conventional fiber materials. The fibers are preferably dispersed throughout the material like a slurry.

The bat 20 of the present invention provides numerous advantages over existing ball bats. The bat 20 of the present invention is configured for impact with actual baseballs and/or softballs and is configured for competitive, organized baseball or softball. For example, embodiments of ball bats built in accordance with the present invention can fully meet the bat standards and/or requirements of one or more of the following baseball and softball organizations: Amateur Softball Association of America ("ASA") Bat Testing and Certification Program Requirements (including the current ASA 2004 Bat Standard and the ASA 2000 Bat Standard); United States Slo-Pitch Softball Association ("USSSA") Bat Performance Standards for baseball and softball; International Softball Federation ("ISF") Bat Certification Standards; National Softball Association ("NSA") Bat Standards; Independent Softball Association ("ISA") Bat Requirements; Ball Exit Speed Ratio ("BESR") Certification Requirements of the National Federation of State High School Associations ("NFHS") and the National Collegiate Athletic Association ("NCAA"); Little League Baseball Bat Equipment Evaluation Requirements; PONY Baseball/Softball Bat Requirements; Babe Ruth League Baseball Bat Requirements; and American Amateur Baseball Congress ("AABC") Baseball Bat Requirements. Accordingly, the term "bat configured for organized, competitive play" refers to a bat that fully meets the ball bat standards and/or requirements of, and is fully functional for play in, one or more of the above listed organizations.

Further, many existing metallic and composite ball bats can provide painful stinging or harsh vibrational feedback from the barrel or hitting portion of the bat through to the handle member or handle portion of the bat especially when the bat contacts the ball away from the "sweet spot" of the barrel. This effect is often heightened at lower temperatures. Bats formed in accordance with the present invention dampen much of the vibrational energy of the bat upon impact, thereby significantly improving the feel of the bat.

Moreover, bats formed in accordance with the present invention can be exceptionally light in weight while retaining strength and durability. Bats of the present embodiments are significantly lighter than wood or aluminum bats. The ability to produce bats at lighter weights makes the embodiments of the present invention particularly well-suited for younger players. A lighter bat can be swung faster by younger players thereby allowing younger players to produce greater bat speed and more productive at-bats.

Additionally, injection-molded bats formed of ABS or other durable polymer, including fiber-reinforced ABS materials, are considerably cheaper to manufacture compared to aluminum, wood, and conventional composite bats. In general, both the raw materials as well as the manufacturing equipment for the injection-molded bats formed in accordance with the present invention are less expensive than the raw material and manufacturing equipment required for making aluminum, wood, and conventional composite bats. Furthermore, the light weight of the injection-molded bats also results in lower shipping costs.

In alternative preferred embodiments, the bat 20 may be formed by injection molding a polycarbonate, a polyvinylchloride, a nylon, other polymers or combinations thereof. One example of a commercially-available material having considerable durability is Surlyn® produced by E.I. du Pont de Nemours and Company, 1007 Market St. Wilmington, Del. 19898 ("DuPont"). In any case, since the bat 20 is formed from a one-piece, injection-molded, hollow bat frame 21, the bat 20 includes no metal components. Thus, the bat 20 is non-metallic. Furthermore, since the bat frame 21 is injection molded as one piece, there is little to no chance of the bat frame 21 separating, as may occur in other injection-molded bats that are molded in multiple parts and subsequently secured together.

The bat frame 21 can be formed from the same material used to make batting helmets, such as ABS or Surlyn®. Thus, the bat 20 may be color coordinated to match a batting helmet. Additionally, graphic designs 40, such as graphical and/or alphanumeric indicia, may be molded in or silkscreened or photo-engraved onto the exterior surface 28 of the bat 20. The resulting bat 20 is beneficial for use in both professional and non-professional sports.

In one preferred embodiment, the bat frame 21 remains hollow, with no core or other inserts within the bat frame 21. A first end cap 32 can be attached to an end 36 of the barrel portion 22 and a second end cap 34 can be attached to an end 38 of the handle portion 26 to complete the formation of the bat 20. A permanent adhesive can be used to attach the end caps 32, 34 to the bat frame 21. Each of the end caps 32, 34 may be formed of the same material as the hollow bat frame 21, such as ABS.

Additionally, the handle portion 26 may be at least partially covered by a gripping material to improve traction and reduce shock to a user's hand. Any suitable gripping material may be used, such as tape used on a variety of sporting equipment handles.

With the structure described herein, the bat 20 can achieve the bat performance factor (BPF) requirements of baseball and softball organizations. BPF can be determined using ASTM F-1881.

Any one or more of the injection-molded bat embodiments described herein may be used in baseball, softball, T-ball, wiffleball, and any other bat-wielding sport. In particular, the injection-molded bat 20 may be used in organized professional league sports and/or in competitive play, such as Little League.

While the preferred embodiments of the invention have been illustrated and described, it will be appreciated that various changes can be made therein without departing from the spirit and scope of the invention. For example, while the embodiments described herein are illustrated in an injection-molded baseball bat, the principles of the present invention could also be used for bats in any other group sport that utilizes bats. Accordingly, it will be intended to include all such alternatives, modifications and variations set forth within the spirit and scope of the appended claims.

What is claimed is:

1. A sports bat comprising a one-piece, injection-molded, hollow bat frame having a barrel portion, a handle portion, and an intermediate portion that tapers from the barrel portion to the handle portion, wherein the handle portion has a convex polygonal cross-section on an interior surface of the bat and a circular cross-section on an exterior surface of the bat.

2. The bat of claim 1, wherein only the handle portion has the polygonal cross-section on the interior surface of the bat.

3. The bat of claim 1, wherein the intermediate portion also has a polygonal cross-section on the interior surface of the bat.

4. The bat of claim 1, wherein the handle portion, the intermediate portion, and the barrel portion each have a polygonal cross-section on the interior surface of the bat.

5. The bat of claim 1, wherein the barrel portion has a circular cross-section on an exterior surface of the bat and a circular cross-section on the interior surface of the bat.

6. The bat of claim 1, wherein the cross-section of the interior surface of the handle portion is a pentagon.

7. The bat of claim 1, wherein the cross-section of the interior surface of the handle portion is a hexagon.

8. The bat of claim 1, wherein the cross-section of the interior surface of the handle is a square.

9. The bat of claim 1, wherein a wall thickness of the bat frame is evenly distributed within a cross-section of each portion of the bat frame.

10. The bat of claim 1, wherein the bat frame is formed of acrylonitrile butadiene styrene.

11. The bat of claim 1, wherein the bat frame comprises a fiber-reinforced material.

12. The bat of claim 11, wherein the fiber-reinforced material comprises fibers selected from the group consisting of fiberglass, aramid, carbon, high molecular weight polyethylene in strand form, and combinations thereof.

13. The bat of claim 1, wherein the bat is non-metallic.

14. The bat of claim 1, further comprising an end cap at an end of the barrel portion and an end cap at an end of the handle portion, wherein each end cap is formed of the same material as the hollow bat frame.

15. The bat of claim 1, further comprising graphical and/or alphanumeric indicia on an exterior surface of the bat.

16. The bat of claim 1, wherein the bat is configured for competitive, organized play.

17. A sports bat comprising a one-piece, injection-molded, hollow bat frame having a barrel portion, a handle portion, and an intermediate portion that tapers from the barrel portion to the handle portion, wherein the intermediate portion has a convex polygonal cross-section on an interior surface of the bat and a circular cross-section on an exterior surface of the bat.

18. The bat of claim 17, wherein the barrel portion also has a polygonal cross-section on the interior surface of the bat.

* * * * *